US008092323B2

(12) United States Patent
Rigoli

(10) Patent No.: US 8,092,323 B2
(45) Date of Patent: Jan. 10, 2012

(54) SPORTS EQUIPMENT STICK WITH TRUSS CONSTRUCTION

(76) Inventor: Michael Rigoli, Wrentham, MA (US)

( * ) Notice: Subject to any disclaimer, the term of this patent is extended or adjusted under 35 U.S.C. 154(b) by 0 days.

(21) Appl. No.: 12/856,716

(22) Filed: Aug. 16, 2010

(65) Prior Publication Data

US 2011/0053715 A1 Mar. 3, 2011

Related U.S. Application Data

(62) Division of application No. 11/023,074, filed on Dec. 27, 2004.

(51) Int. Cl.
*A63B 59/02* (2006.01)
*A63B 65/12* (2006.01)

(52) U.S. Cl. ..... 473/513; D21/724

(58) Field of Classification Search ..... 473/505, 473/512, 513; D21/724
See application file for complete search history.

(56) References Cited

U.S. PATENT DOCUMENTS

| | | | | | |
|---|---|---|---|---|---|
| 1,707,787 | A * | 4/1929 | Estwing | 81/22 |
| 3,647,211 | A * | 3/1972 | Doessel et al. | 473/535 |
| 4,124,208 | A * | 11/1978 | Burns | 473/562 |
| 4,932,659 | A * | 6/1990 | Freeberg | 473/238 |
| 5,026,062 | A * | 6/1991 | Freeberg | 473/238 |
| 5,603,498 | A * | 2/1997 | Crawford et al. | 473/563 |
| 5,766,104 | A * | 6/1998 | Albarelli, Jr. | 473/567 |
| 5,879,250 | A * | 3/1999 | Tahtinen et al. | 473/561 |
| 6,241,633 | B1 * | 6/2001 | Conroy | 473/561 |
| 2003/0045380 | A1 * | 3/2003 | Tucker, Sr. | 473/513 |
| 2005/0153799 | A1 * | 7/2005 | Rigoli | 473/513 |
| 2006/0122013 | A1 * | 6/2006 | Dodge et al. | 473/516 |
| 2007/0275800 | A1 * | 11/2007 | Davis et al. | 473/561 |

* cited by examiner

*Primary Examiner* — Gene Kim
*Assistant Examiner* — M Chambers
(74) *Attorney, Agent, or Firm* — Bay State IP, LLC; Adam J. Bruno

(57) ABSTRACT

A sports stick exhibiting a superior strength to weight ratio. The sports stick design allows for decreased flexure, increased rigidity and increased durability, which lend to greater generation of force, accuracy, reliability and longer life expectancy. The sports stick utilizes aerodynamic features in order to achieve an exposed truss like structure which permits airflow through the internal sections of the shaft which creates greater shaft acceleration and velocity. The sports stick also affords enhanced strength in the direction of a shot and receipt of a pass. The sports stick also provides for channeling away of fluids throughout the length of the stick. The sports stick also provides a system wherein weight can be regulated in multiple regions throughout by utilizing removable or fixed weighted elements or by sizing of cutaways strategically designed to be placed in a certain area of the stick, depending on player handling preference.

17 Claims, 20 Drawing Sheets

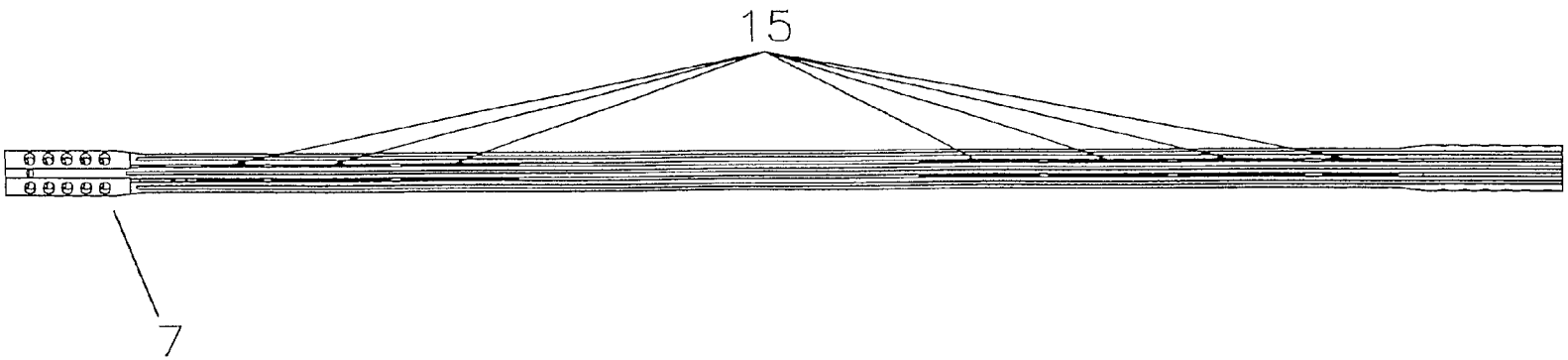
FIGURE 6
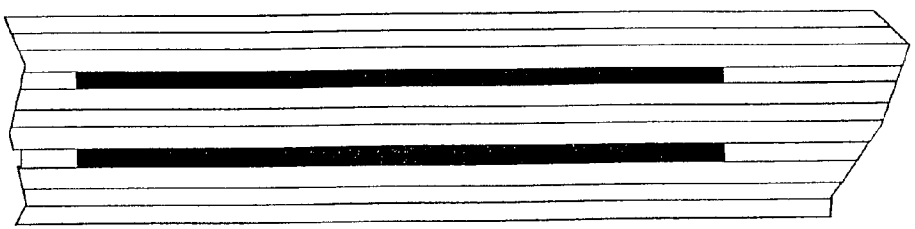
FIGURE 6-A

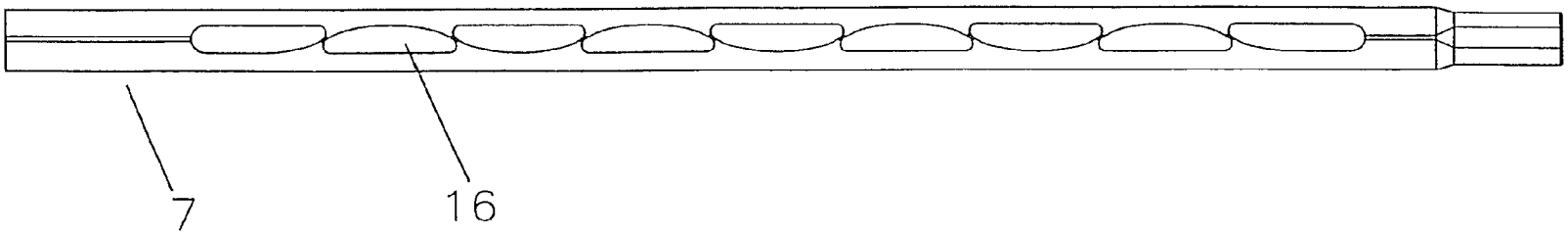
FIGURE 7
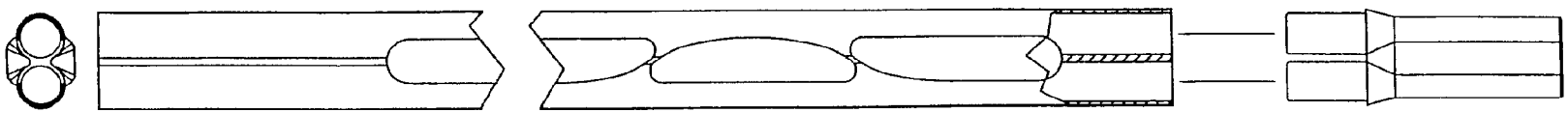
FIGURE 7–A

SPORTS EQUIPMENT STICK WITH TRUSS CONSTRUCTION

CROSS REFERENCE TO RELATED APPLICATION

This application is a divisional of and claims the benefit of pending U.S. application Ser. No. 11/023,074 filed on Dec. 27, 2004.

FIELD OF THE INVENTION

The present invention relates generally to sporting goods, namely sticks, shafts and bats for sports such as hockey, lacrosse, field hockey, golf, baseball, softball, polo and fishing.

BACKGROUND OF INVENTION

As designs of sports shafts, stick and handles have evolved from basic wooden structures lacking uniformity as to quality, strength, weight, and susceptibility to failure by fracturing. Many prior inventions have proposed the use of shafts or sticks comprising composites featuring plastic outer surfaces with inner cores of wood or aluminum. Further, as pointed out by prior inventions, many attempts have been made to utilize metallic material in the manufacture of sticks.

The utility U.S. Pat. No. 3,473,806 issued to Patterson, discloses a lacrosse stick with a frame composed of reinforced plastic material with a much lighter material inserted into its core. Although a lightweight stick may results from this design, the requisite strength and durability needed for full contact, high energy engagement are not present.

Further, the utility U.S. Pat. No. 4,739,994 issued to Lewis discloses a lacrosse stick having an octagon or elliptical shape where the stick is graphite loaded to increase elasticity and strength. Although the admixing and molding of graphite and plastic to the shaft weight has merit regarding weight requirements, the same basic solid frame is utilized and thus aerodynamic advantages are not reached.

Moreover, the utility U.S. Pat. No. 3,702,702 issued to Hoult reveals a handle with a plastic tube with inwardly extending ribs that engage a rod for strength. Once again, although strength to weight ratio may be enhanced, aerodynamic characteristics are not addressed.

While metallic handles, such as those described in U.S. Pat. Nos. 4,206,918 and 4,037,841, have evinced many beneficial qualities and have been widely accepted by players, these designs fail to maximize the properties of aerodynamics combined with weight considerations.

A further important attribute with respect to lacrosse sticks pertains to user recognition of the head or striking surface position when the stick is not in the view of the user. Prior stick designs fail to create provisions for head position recognition and utterly ignore this quality. The utility U.S. Pat. No. 4,206,918 issued to Lewis reveals a lacrosse stick with a metallic handle and knurling. The knurling consists of protrusions over the surface of the lacrosse stick aiding in grasping the stick. However, the uniform quality of the knurling throughout the circumference of the stick fails to afford the user any cognizance of the head position. Further the knurled gripping area fails to extend down the entire length of the stick. Thus, the stick will have a tendency to slip on the entirely smooth surfaces with perspiration or water build up in inclement weather.

The utility U.S. Pat. No. 6,500,079 B1 issued to Tucker discloses a stick with a uniform ribbed design along the length of the shaft. Once again, the uniformity of the design wholly fails to give the user any indication of the position of the striking surface.

What is needed is a design of sports stick or shaft possessing the requisite strength and durability characteristics of a metal handle and the weight, handling and production characteristics of a plastic handle has not been available to the lacrosse player. What is further needed is a Lacrosse stick that allows the user to constantly be cognizant of the position of the head.

Prior to the introduction of the present invention, the major focus has lied mainly in matters concerning materials to be utilized to minimize weight, as opposed to structural and aerodynamic considerations. The instant invention combines the material breakthroughs developed over recent shaft design with the obvious advantages of aerodynamic research.

For these reasons, a stick or shaft with a focus on creating the lightest weight yet most aerodynamic configuration is needed. Further, a stick that consistently renders the user cognizant of the head position is needed.

SUMMARY OF THE INVENTION

The present invention reveals the next generation in sports shaft and stick technology. The instant design incorporates trusses and curved cutaway surfaces to add strength, reduce weight and provide aerodynamic airflow to sports sticks, and in particular to lacrosse sticks, is not revealed by the prior cited patents. The instant invention is designed with both concave and convex surfaces to enhance the strength of the handle in all directions. This concept utilized in the instant invention follows the design of an aircraft wing, where strength to weight ratio is extremely important.

The present invention utilizes the airfoil shape, typical in airplane wing and fuselage design, to create a superior stick profile in regard to airflow considerations. By incorporating this airfoil concept into material cutaways manufactured in a truss-like structure, through either the whole or some portion of the stick, the resultant combination of the aerodynamic advantages and the strength inherent in the curved truss surfaces, provides a drastically upgraded sport stick. Further, incorporating modern material considerations into the instant design only serves to render a lighter, stronger stick.

It is an object of the present invention to provide a multi-application sports stick or shaft that exhibits superior durability. It is an object of the present invention to provide a multi-application sports stick or shaft that exhibits the feel and handling capabilities of a lightweight shaft at heavier weights, due to the airfoil design.

It is an object of the present invention to provide a multi-application sports stick or shaft that exhibits the feel and handling capabilities of a lightweight shaft and delivers greater force to an object to be moved due to the truss and airfoil design.

It is an object of the present invention to provide a multi-application sports stick or shaft that exhibits superior handling and response capabilities than prior designs. It is another object to allow the user to know the position of head or striking surface at all times without having to view the head or striking surface. It is another to minimize loss of energy on the back stroke.

It is another object of this invention to maximize the force generated by creating a more rigid shaft and thus losing less energy on the back stroke. It is another object of this invention to provide a sports stick or shaft exhibiting the rigidity characteristics of wood or heavy metals while providing the performance and operational characteristics of much lighter materials such as plastic handles or aluminum sticks or shafts.

It is another object of this invention to provide a sports stick or shaft exhibiting greater accuracy due to the rigidity characteristics of the truss structure and the inherent lack of flexure.

It is another object of this invention to provide a lacrosse stick which provides the user with a constant indication of the head position. It is another object of this invention to provide a stick which utilized enhanced carbon fiber weaves to the maximum.

It is another object of this invention to provide a stick possessing gripping grooves extending the length of the stick. It is another object of this invention to provide a stick possessing a truss shape that can be accomplished by utilizing any number of cross sectional design schemes, including round, square, rectangular.

These and other features, aspects and advantages of the present invention will become better understood with reference to the following description, claims, and accompanying drawings. Therefore, the form of the invention, as set out above, should be considered illustrative and not as limiting the scope of the following claims.

BRIEF DESCRIPTION OF DRAWINGS

FIG. 6 is a top plan view of the stick rotated 90 degrees to illustrate the airflow through slots 15 located within the grooved gripping area extending the length of the stick;

FIG. 6A is an exploded top plan cutaway view of the stick rotated 90 degrees to further illustrate the airflow through 15 located within the grooved gripping area extending the length of the stick;

FIG. 7 is a top plan view of the stick with airfoil shaped cutouts extending the length of the shaft and further illustrating the dual tube fastened shotgun design which features construction from two tubular members with a third member attached as an adapter to add a lacrosse head;

FIG. 7A is an exploded top plan view of the stick with airfoil shaped cutouts extending the length of the shaft and further illustrating the dual tube fastened shotgun design which features construction from two tubular members with a third member attached as an adapter to add a lacrosse head;

DESCRIPTION OF THE INVENTION

Figure 1:
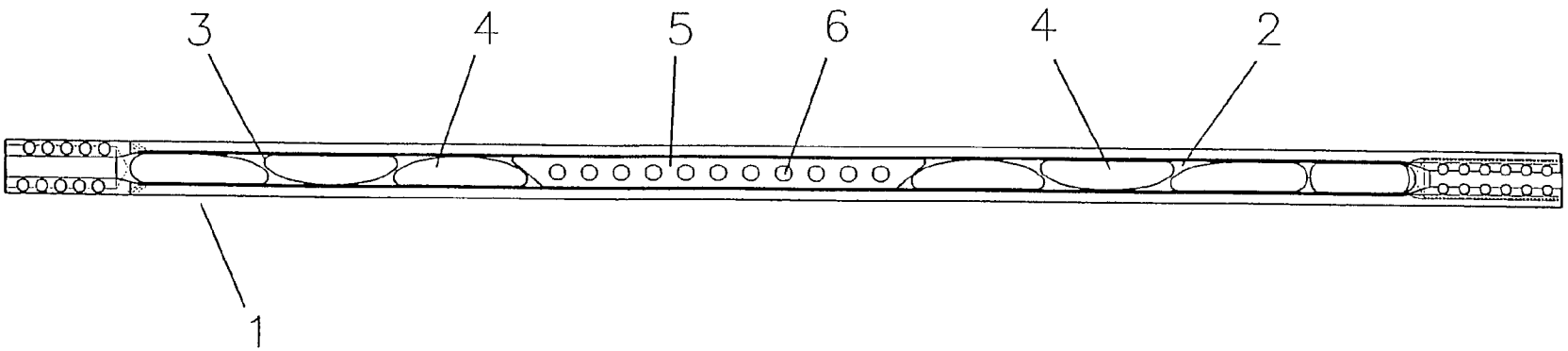
FIG. 1 hereof is a top plan view of the stick with dual airfoil areas partitioned by an area featuring circular cutaways.

Referring now to FIG. 1, there is shown a stick construction comprising a shaft 1 equipped with three areas possessing cutaways or cavities. Further shown in divided segments are the upper region 2 and lower two region 3. Each of these regions containing series of airfoil shaped cavities 4. Positioned between the upper and lower regions is a central region 5, containing circular shaped cavities 6.

Figure 2:
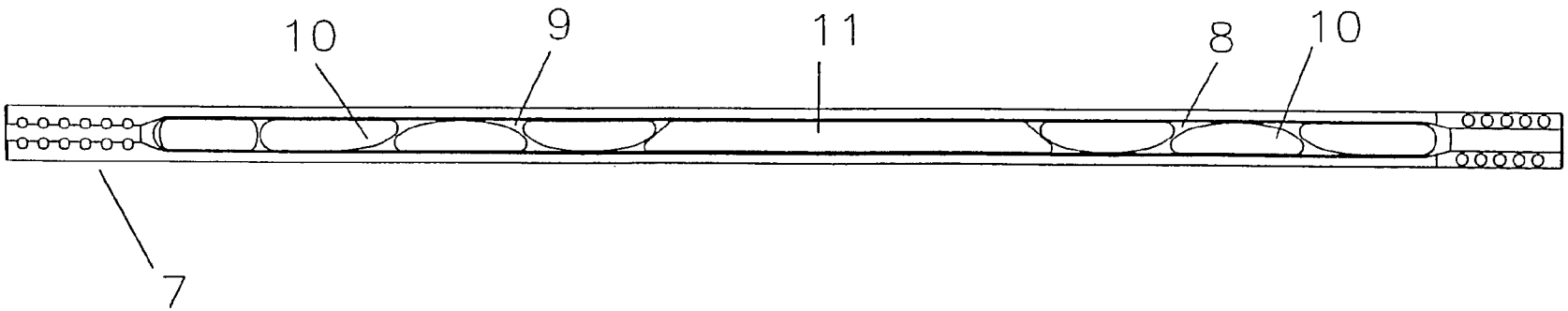
FIG. 2 is a top plan view of the stick with dual airfoil areas partitioned by a solid area.

Referring next to FIG. 2, there is shown a stick construction comprising a shaft 7 equipped with three areas possessing cutaways or cavities. Further shown in divided segments are the upper region 8 and lower two region 9. Each of these regions containing series of airfoil shaped cavities 10. Positioned between the upper and lower regions is a solid central region 11. Further embodiments can include a shaft containing airfoil shaped hole through the entirety of the length.

Figure 3:
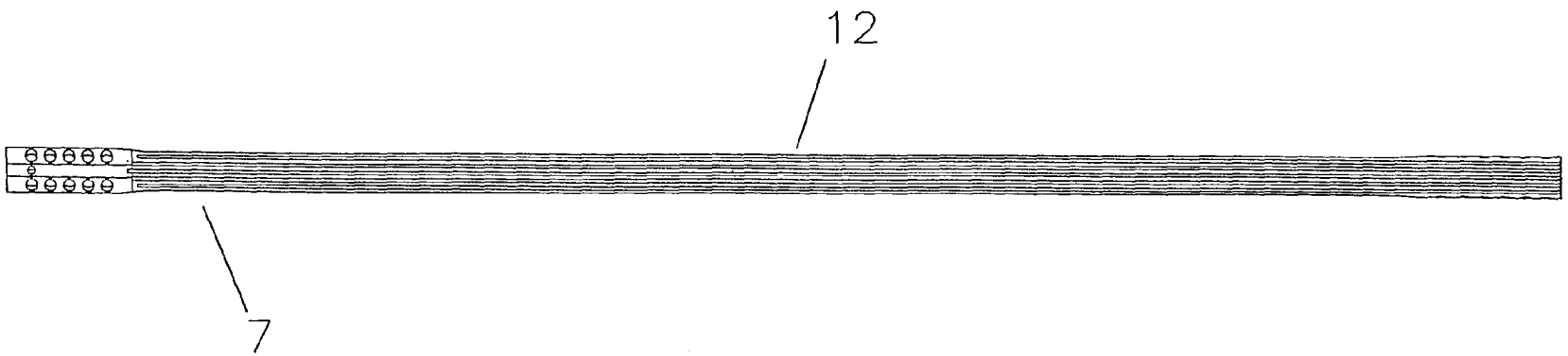
FIG. 3 is a top plan view of the stick rotated 90 degrees to illustrate the grooved gripping area extending the length of the stick.

Referring to FIG. 3, there is shown a shaft 7 equipped with the grooved gripping area 12 extending the length of the stick. In one embodiment, a typical shaft contains two grooved areas positioned on opposing sides of the shaft in such a manner as to allow the user to continuously identify the position of the stick head or striking surface.

Figure 4:
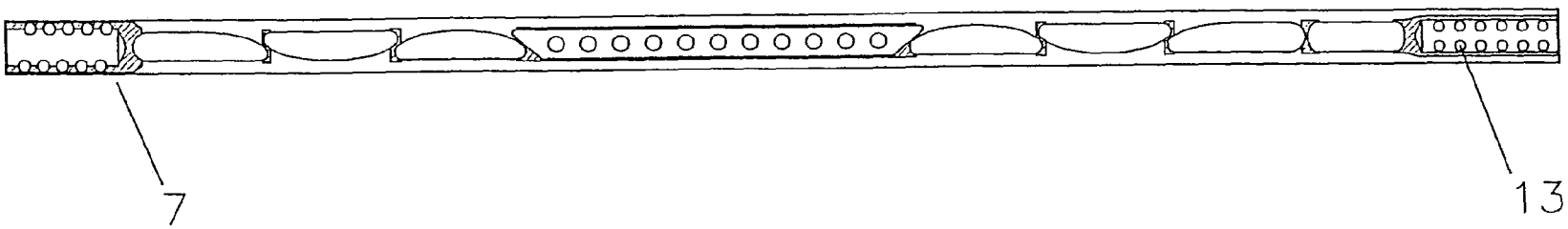
FIG. 4 is a top plan sectioned view of the stick illustrating the shaft containing circular airflow cutouts in the handle.

Referring next to FIG. 4, there is shown a stick construction comprising a shaft 7 equipped with three areas possessing cutaways or cavities. In one embodiment, the shaft contains circular airflow cutouts 13 in the handle. These circular holes allow for additional weight reduction along with additional airflow through the shaft.

Figure 5:
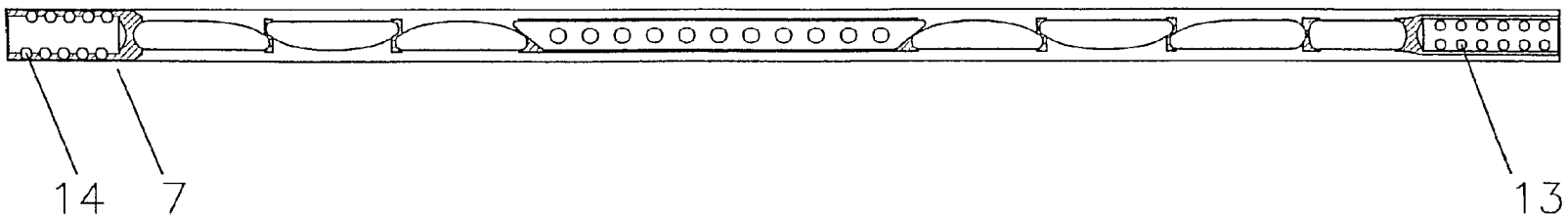
FIG. 5 is a top plan sectioned view of the stick illustrating the shaft containing circular airflow cutouts in the area where the head is mounted.

Referring to FIG. 5, in one embodiment, the shaft 7 contains circular airflow cutouts 14 in the area where the head or striking surface is mounted. These circular holes allow for additional weight reduction along with additional airflow through the shaft in all directions.

Referring to FIG. 6, in one embodiment, a shaft 7 is shown equipped with airflow slots 15 located within the grooved gripping area extending the length of the stick.

FIG. 6A further illustrates these through slots. In this configuration, when combined with the airfoil shaped cutouts, a maximum weight reduction along with a maximum airflow through the shaft in all directions can be achieved. Ergo, the shaft may contain circular airflow cutouts in the area where the striking surface is mounted to allow for air flow through the shaft on the sides opposite to the direction of striking and circular airflow cutouts in the area where said striking surface is mounted to allow for air flow through the shaft on the sides adjacent to the direction of striking. Most importantly, this through slot design allows for unfettered airflow in the direction of the shot.

Figure 8:
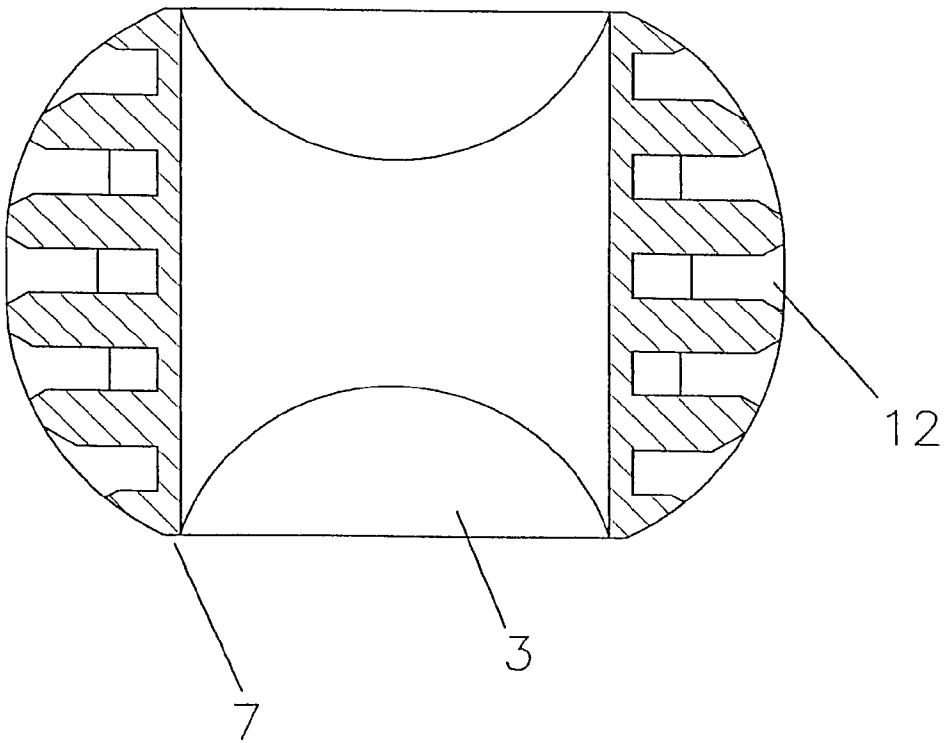
FIG. 8 is a side view looking down the shaft to illustrate the circular airflow cutouts truss structure and the grooved gripping area.
Figure 9:
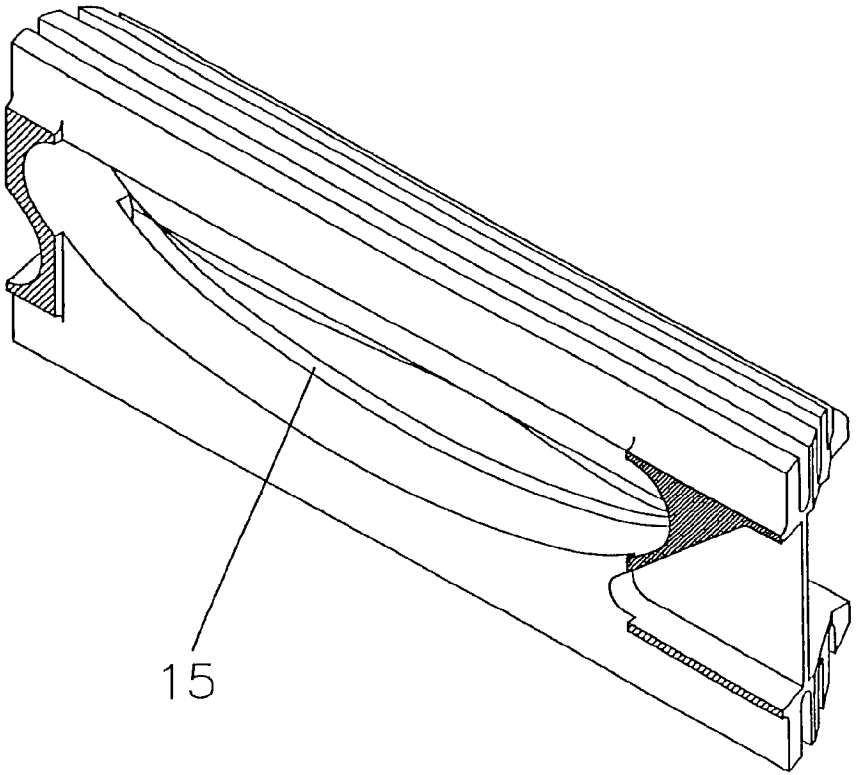
FIG. 9 is an isometric view looking at the through slot view in the grooved gripping area.

Referring to FIG. 7, in one embodiment, the stick may contain airfoil shaped cutouts 16 extending the length of the shaft. This embodiment as shown is constructed from two tubular members with a third member attached as an adapter to add a lacrosse head. FIG. 7A is an exploded top plan view of the stick with airfoil shaped cutouts extending the length of the shaft and further illustrating the dual tube fastened shotgun design which features construction from two tubular members with a third member attached as an adapter to add a lacrosse head. FIG. 7A also illustrates the end view where the adapter is removed. As discussed further below, this variation could entail fusing two members of the same material or using dissimilar materials such as fusing a tubular plastic member with a tubular aluminum member. FIG. 8 is a side view looking down the shaft 7 to illustrate the concave/convex construction and the concave circular airflow structure 3 and the convex grooved gripping area 12. FIG. 9 is an isometric view looking at the through slot 15 placed in the grooved gripping area.

Figure 10:
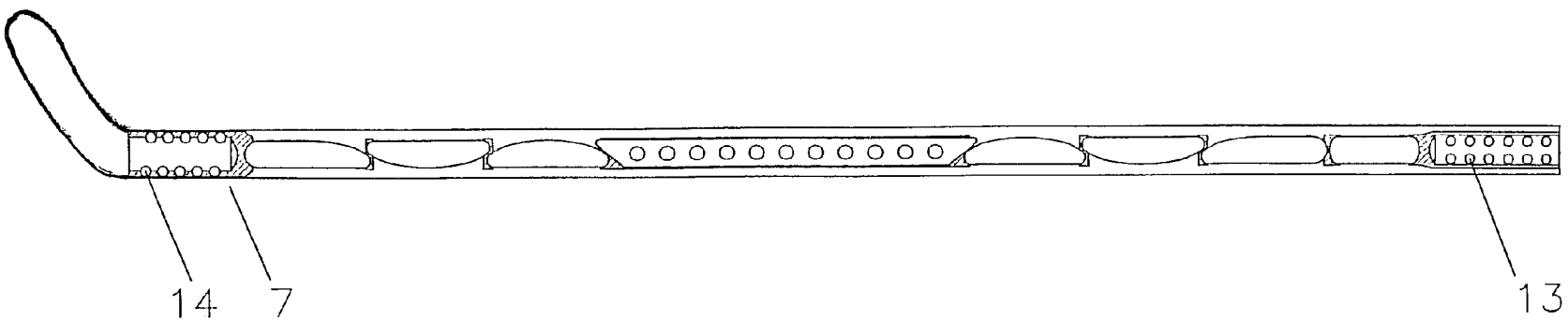
FIG. 10 is a top plan view of the stick with an attached blade type striking surface.
Figure 11:
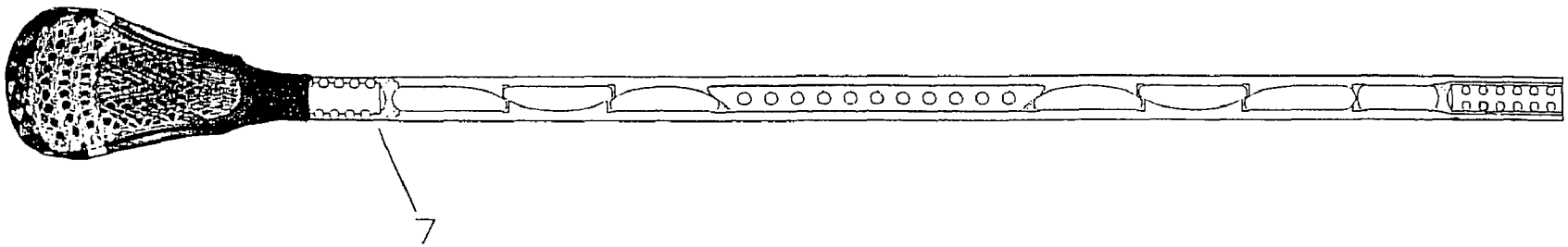
FIG. 11 is a top plan view of the stick with an attached lacrosse head type striking surface.
Figure 12:
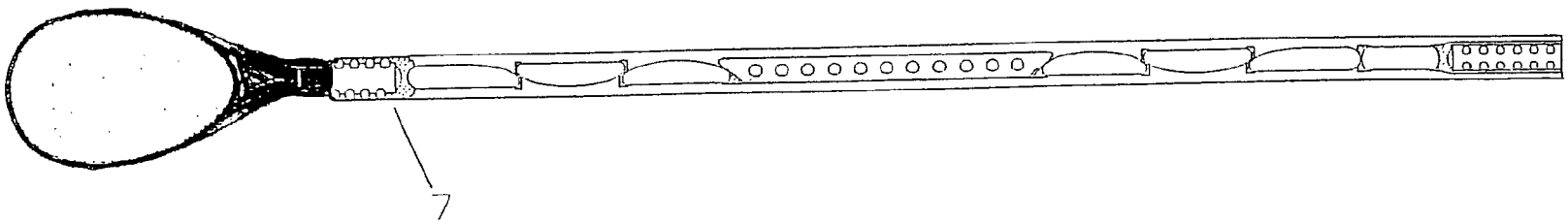
FIG. 12 is a top plan view of the stick with an attached racquet type striking surface.

FIG. 10 is a top plan view of the stick with an attached blade type striking surface. FIG. 11 is a top plan view of the stick with an attached lacrosse head type striking surface. FIG. 12 is a top plan view of the stick with an attached racquet type striking surface.

Figure 13:
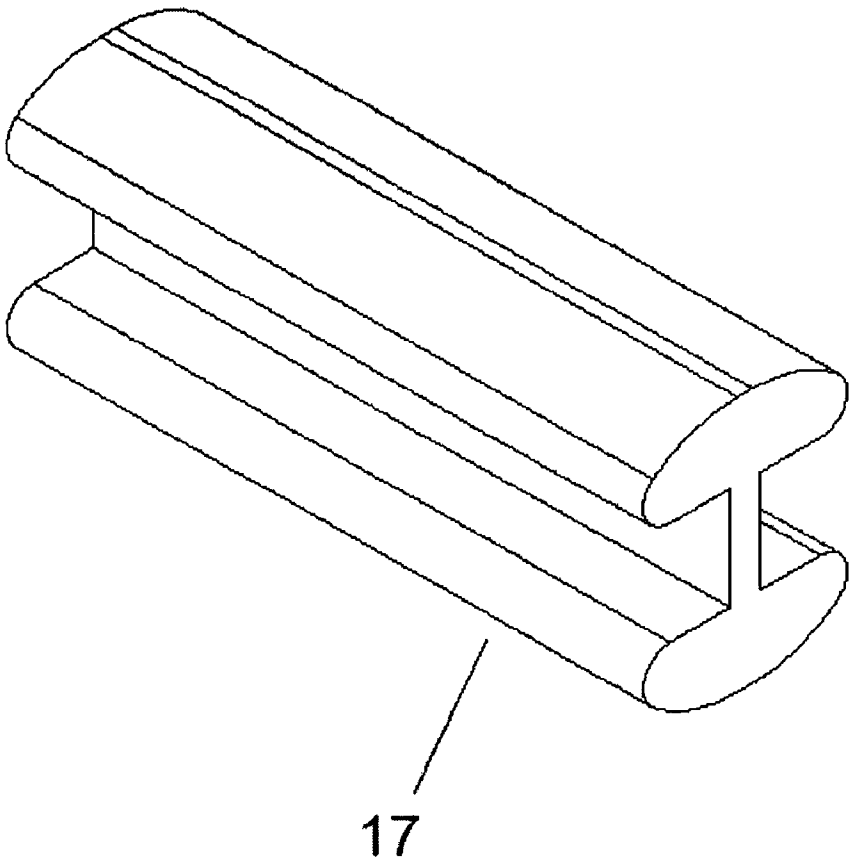
FIG. 13 is a cutaway isometric view illustrating the single I-beam embodiment.
Figure 14:
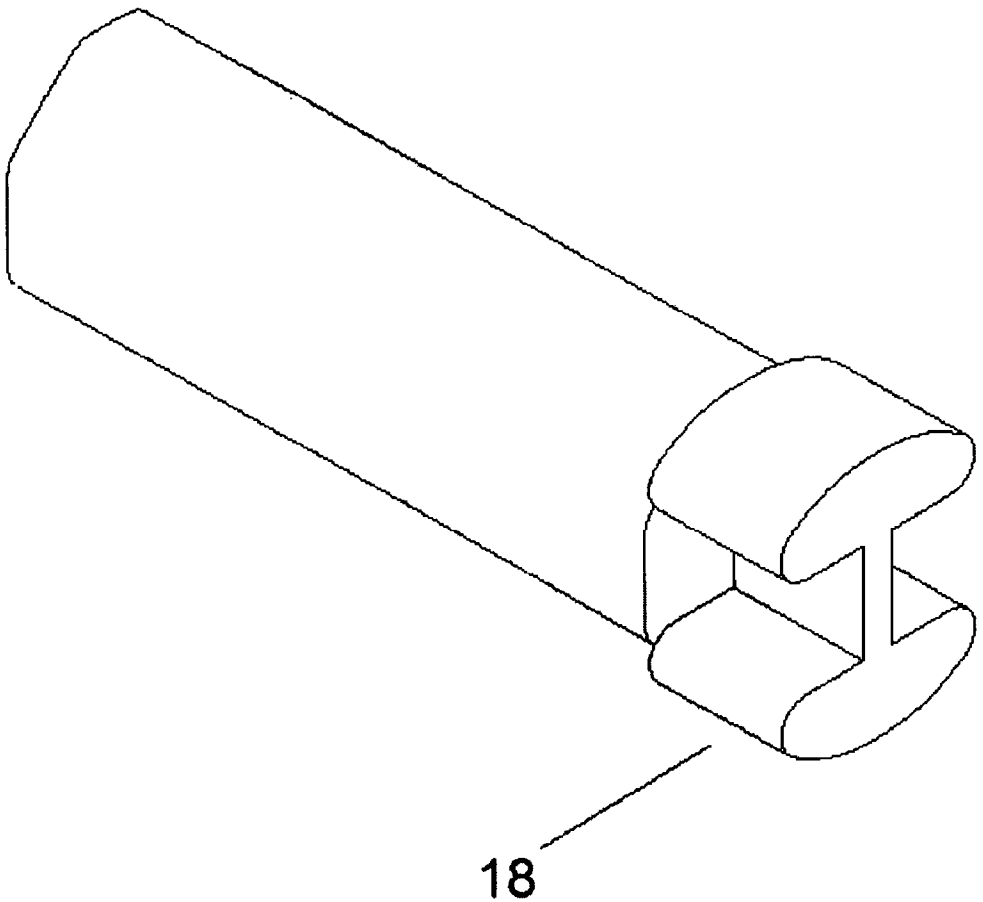
FIG. 14 is an isometric view of the stick illustrating the single I-beam embodiment in one section.
Figure 15:
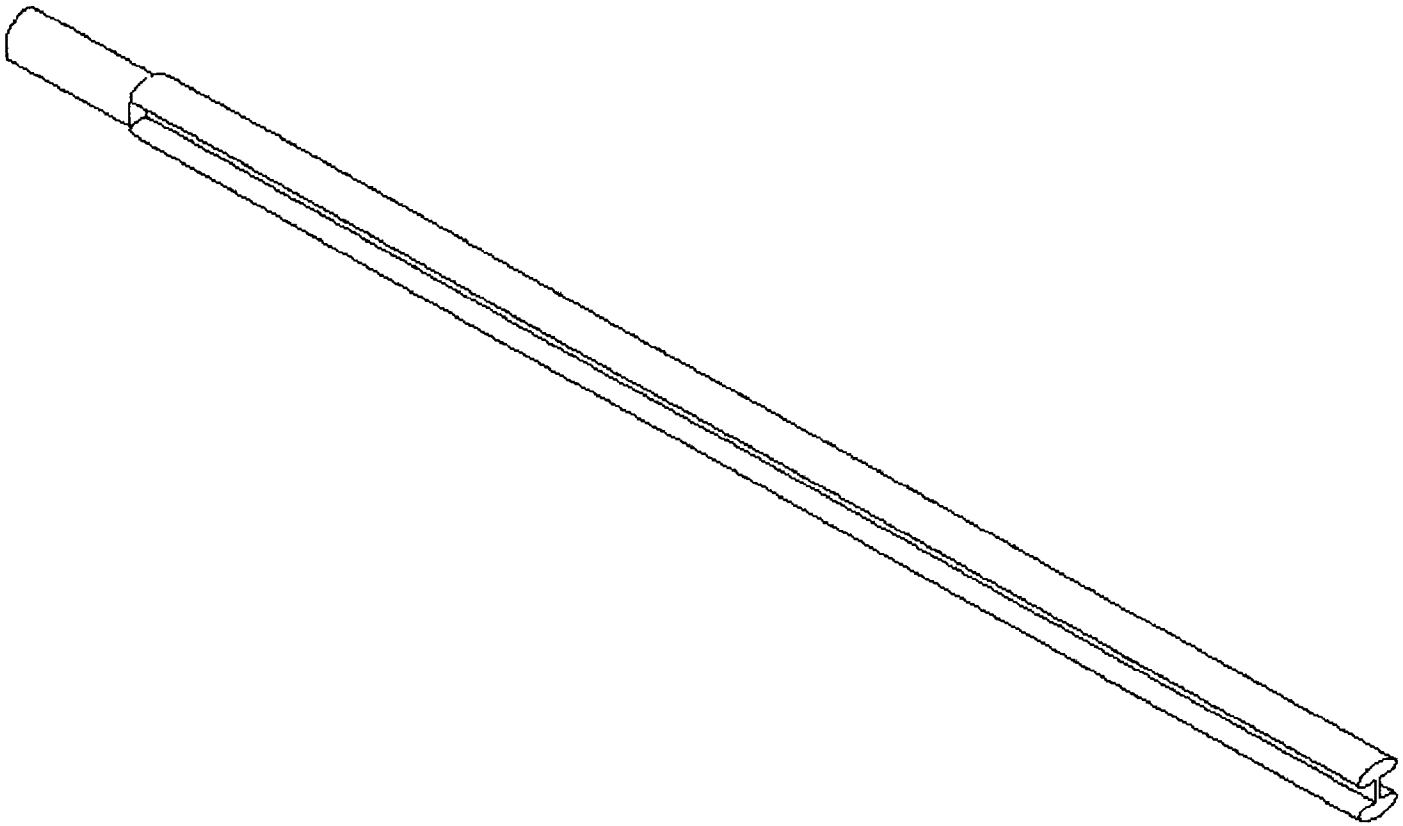
FIG. 15 is an isometric view of the stick illustrating the single I-beam embodiment throughout the entirety of the stick.
Figure 16:
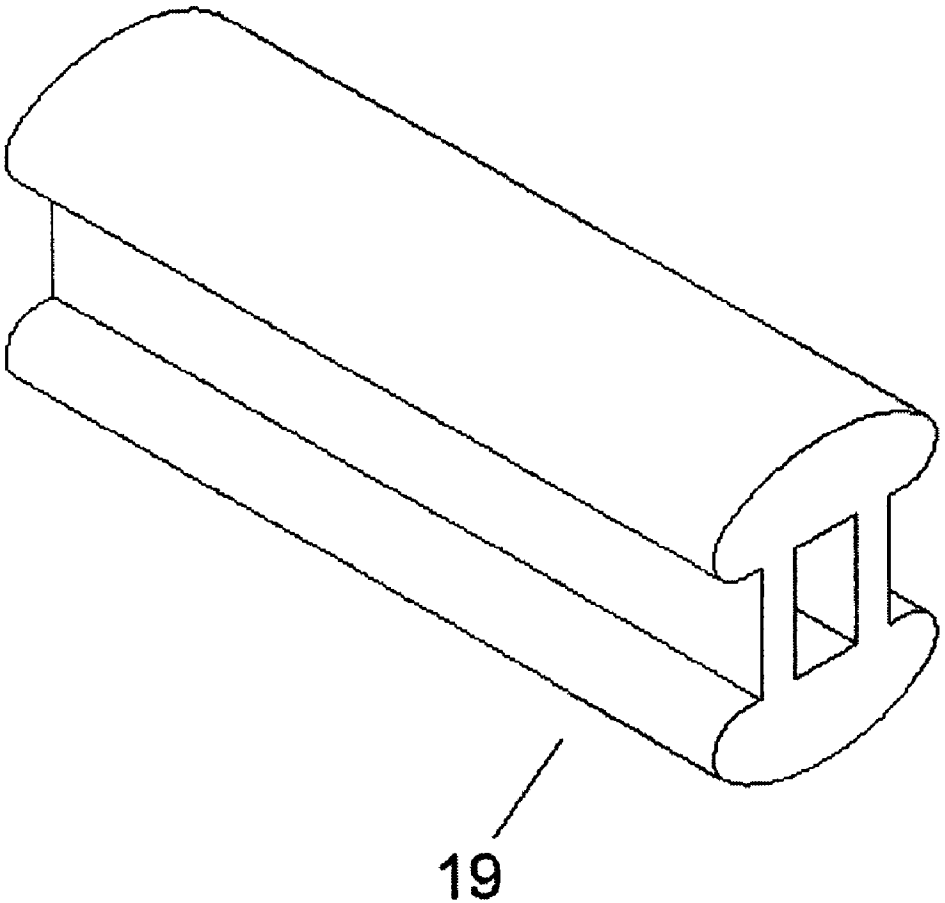
FIG. 16 is a cutaway isometric view illustrating the double I-beam embodiment.
Figure 17:
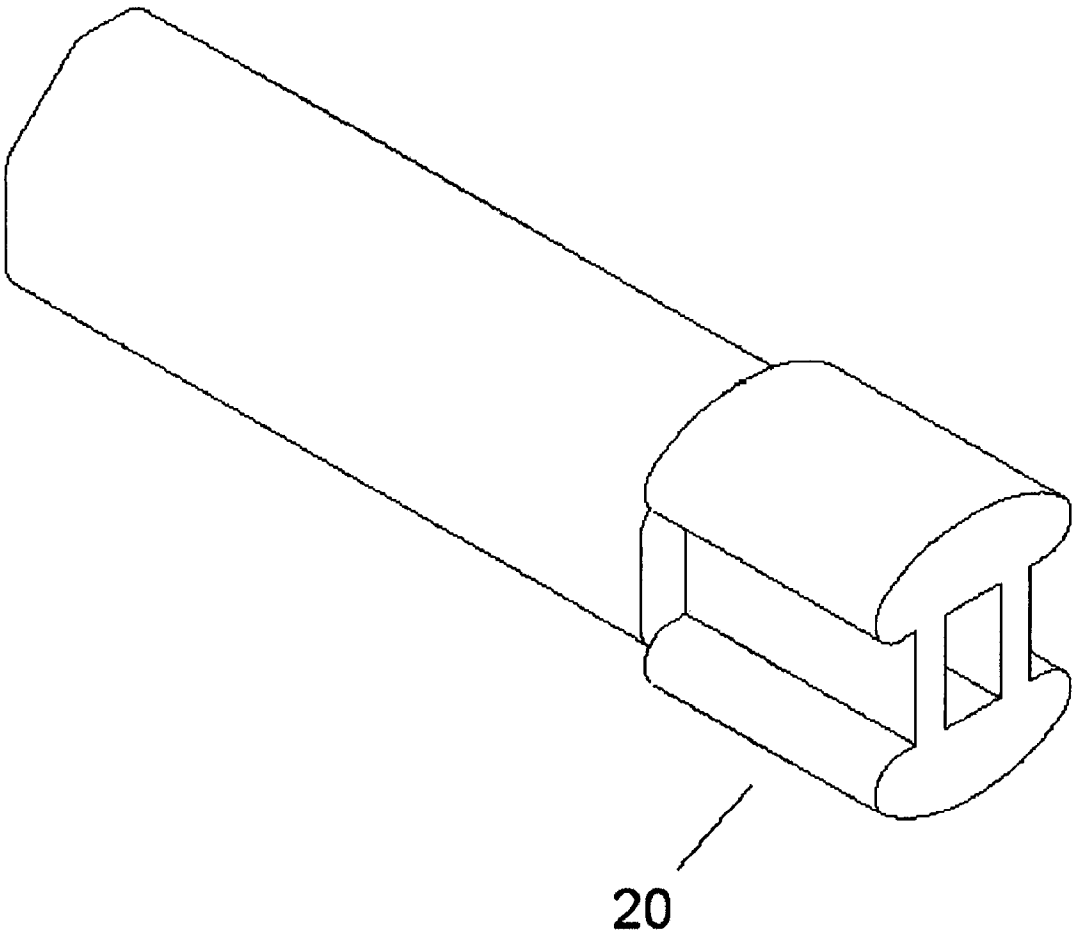
FIG. 17 is an isometric view of the stick illustrating the double I-beam embodiment in one section.
Figure 18:
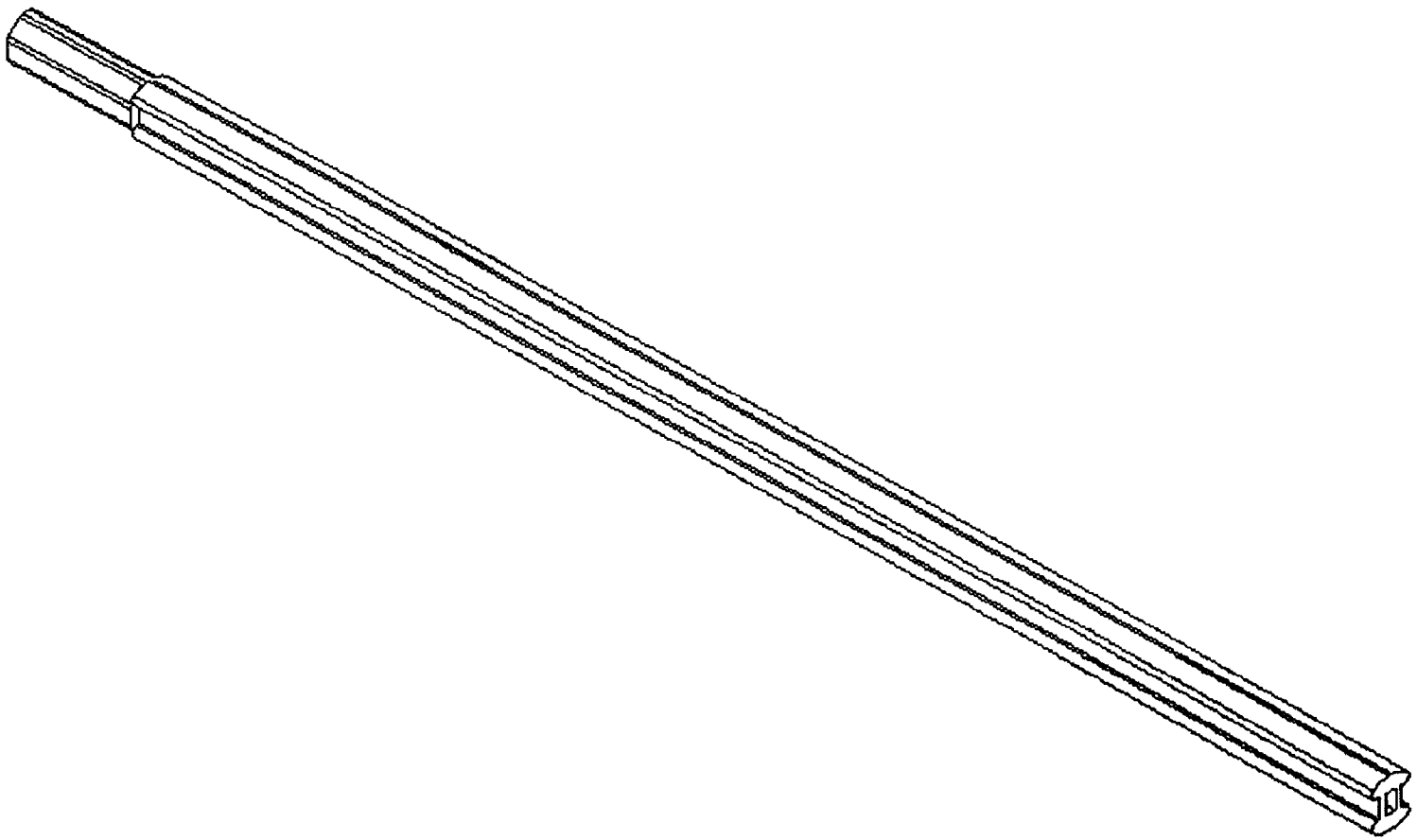
FIG. 18 is an isometric view of the stick illustrating the double I-beam embodiment throughout the entirety of the stick.
Figure 19:
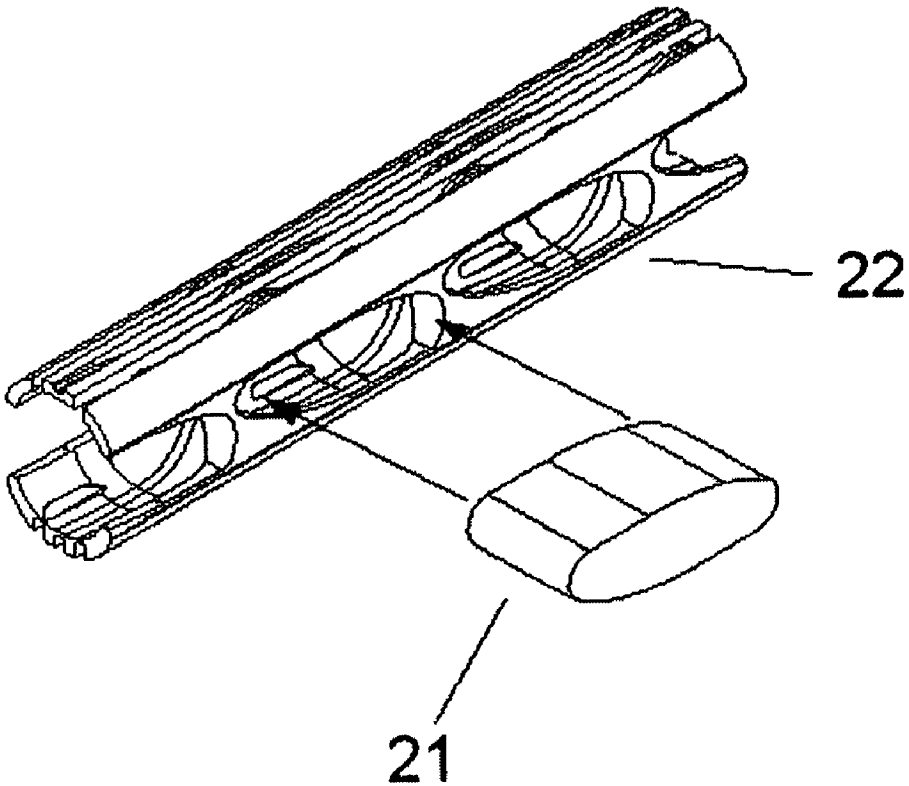
FIG. 19 is an isometric view of the stick illustrating the removable weight and its location on the stick.
Figure 20:
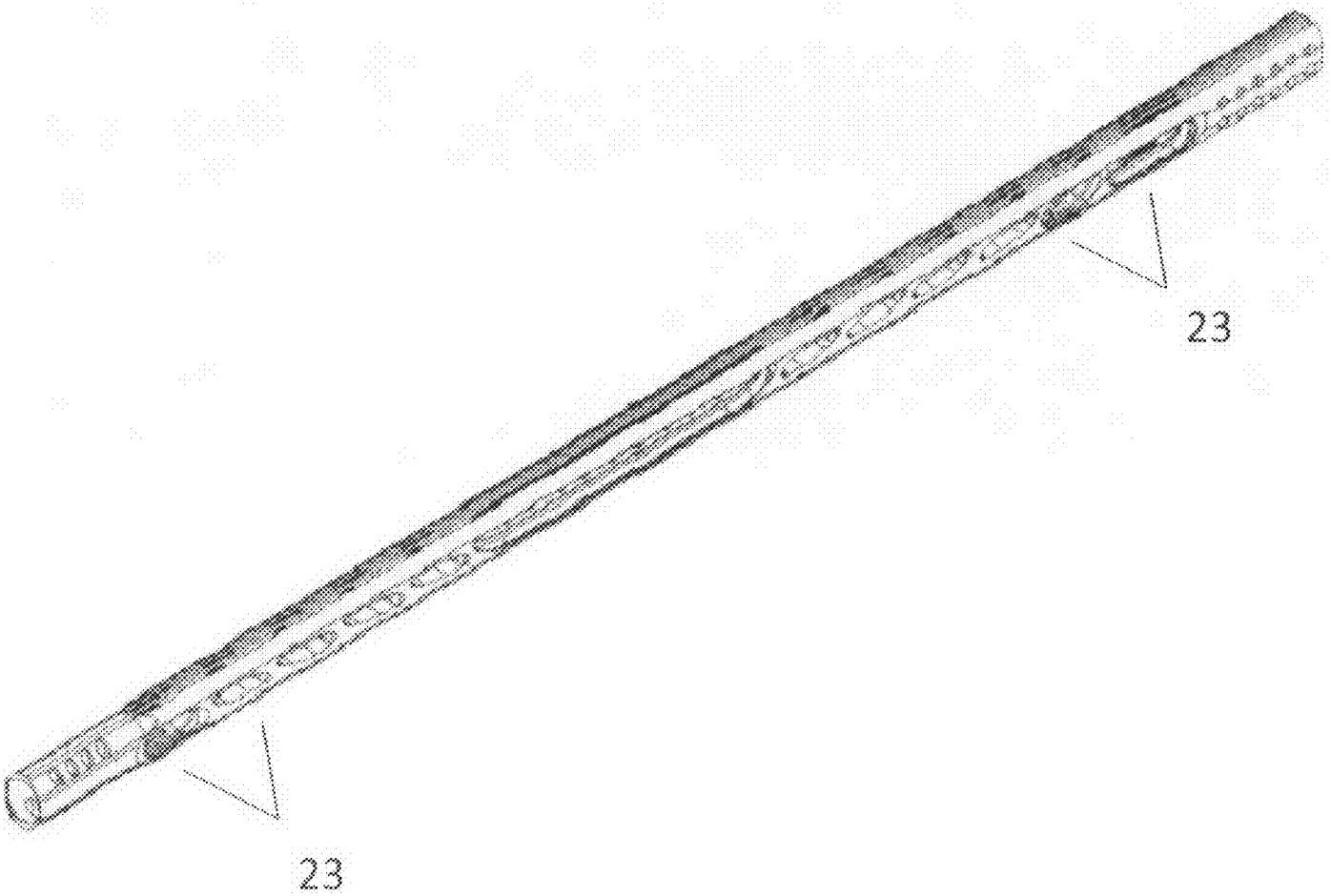
FIG. 20 is an isometric view of the stick illustrating the differentiation in weight distribution by cutaway sizing.

FIG. 13 is an isometric view of the stick illustrating the single I-beam embodiment 17. FIG. 14 is an isometric view of the stick illustrating the single I-beam embodiment confined to only one section 18 of the stick. FIG. 15 is an isometric view of the stick illustrating the single I-beam embodiment throughout the entirety of the stick. FIG. 16 is an isometric view of the stick illustrating the double I-beam embodiment 19. FIG. 17 is an isometric view of the stick illustrating the double I-beam embodiment confined to only one section 20 of the stick. FIG. 18 is an isometric view of the stick illustrating the double I-beam embodiment throughout the entirety of the stick. FIG. 19 is an isometric view of the stick illustrating the removable weight 21 and the location of the retaining surface 22 on the stick. FIG. 20 is an isometric view of the stick illustrating the differentiation in weight distribution by cutaway sizing 23.

The novel design of the instant invention is no way limited regarding basic shaft shapes. The sports stick may possess an external surface which is cylindrical in shape. Additionally, the sports stick may possess an external surface which is hexagonal in shape. Further, the sports stick may possess an external surface which is cylindrical in shape. Thus, the stick can embody any multisided shape to accommodate differing head types.

In one embodiment, there exists a sports stick comprising a handle and a shaft wherein said shaft including at least one cutaway area. The sports stick may further contain a multiplicity of cutaway areas. The sports stick may further contain a multiplicity of curved cutouts. These curved cutouts may be in the shape of an airfoil and the multiplicity of cutouts can be designed to form a truss structure, which provides for superior strength and allows for a superior flow path for air through the internal area which is filled in prior stick designs. Thus, the novel invention enhances structural integrity, especially in the vectorial direction of the force exerted on the object to be moved, while also allowing for air flow directly through the structure of the stick of a greater volume than the flow along the outer edges of the stick.

In further regard to structural integrity, upon contact with an obstacle, due the curved, truss-like structure, the shaft will exhibit a tortional or rotational action, instead of the usual buckling effect of a cylindrical member. Also, due to the truss structure, the instant shaft will not buckle upon receiving a dent on the field of play. A further important attribute inherent in the instant invention centers around superior durability and greater longevity of the shaft, due to the rigidity and rotational characteristics of the truss structure. The lack of flexure also assists with the orientation and head alignment toward recovery of ground balls. The torsion affect also assists the user during faceoffs and alignment of head to ground to compensate for the recovery of ground balls. Additionally, the truss structure does allow for flexure in the planes 90 degrees away from the striking direction and receiving direction. Thus, the instant stick will still have the flexure needed for checking, while retaining the stiffness for maximum striking and receiving characteristics.

A major advantage of the truss structure surfaces centers around upon receipt of a pass by the user. Utilization of the truss configuration greatly minimizes the flexure present upon receiving a pass. Thus, the user does not lose position, momentum or control, even when the object received is traveling at a great velocity.

Further the instant stick may include a multiplicity of grooves extending along the entire length of the shaft in order to channel water away from the gripping surfaces. The indentation of the internal cutaways also inherently serves to assist in water removal during inclement weather by providing a roll off area and also less surface for water to accumulate upon. Prior designs attempting to utilize grooves only possess grooves along the handle area and fail to incorporate the cutaway areas. Thus, water is allowed to collect at the end of the gripping area.

Further, the grooved gripping area, along with the shape accomplished with the cutaway areas introduced in the instant invention prevents the shaft from rotating out of the hand of the user since the cutaway areas provide a positive grip not found on basic polygonal shaped shafts. Thus, this positive grip, in combination with the truss structure helps to prevent head and shaft rotation upon receipt of a pass, and thus affords the user far greater control of the shaft. Moreover, the cutaway design and the location of the grips on opposing sides of the shaft serves to consistently indicate the orientation of the striking surface or head of the invention due to the location. Thus, a user never has to glance at the stick in order to know that the head is in proper striking position.

A solid or slotted rubber gripping handle made be attached to the upper portion of the shaft for a softer feel. As a further embodiment, circular cutaways may be placed in the grooved gripping area. These cutaways will serve to allow air flow and water flow through the gripping area.

An additional important attribute of the instant appears in the minimization of flexure due to the curved surfaces in the form of a truss. Thus, on the wind up and follow through during the delivery of a strike, flexure of the stick is minimized. Thus, the user does not have to compensate for a major backward force upon the backstroke and thus, this lack of flexure in combination with the maximized shaft velocity inherent with the curved cutout design insures that the force upon strike is maximized.

It is an object of the present invention to provide a multi-application sports stick or shaft that exhibits the feel and handling capabilities of a lightweight shaft even at heavier weights, due to the airfoil design. Thus, although the user will gain more power from the heavier shaft, the aerodynamic capabilities of the shaft will create a lighter feel during play and thus tend not to tire the user.

Further, among the utmost facets of the instant invention centers around the inherent ability of the instant shaft to be to be manufactured from dissimilar materials. Due to the properties intrinsic in single shape, cylindrical type shafts, prior shafts are presently unable to be manufactured from dissimilar materials. This capability allows the present invention to utilize the strengths of different materials in both the operational and the aesthetic realm. For example, certain users may favor the feel or other characteristics of a wooden handle. Thus, the instant invention can feature differing raw materials such as wood, polymers, light metals, heavier metals, carbon fibers and composites, all utilized in concert to produce a desired result. For example the raw materials that can be combined to create a shaft are not limited to, but could include, plastic on two sides with wood in between to create a different feel, and still optimize weight and rigidity characteristics.

In regard to manufacturing attributes, the novel stick may be manufactured from any material, including but not limited to aluminum, titanium, composite graphite and carbon fiber. Additionally, the stick may be produced of tubular shaped raw, even dissimilar materials or components in the shape of squares, rectangles, rounds, or hexagons. Due to the novel, non tubular design of the instant invention, in regard to methods of production, the shaft may be manufactured from dissimilar materials and shapes of material, joined together by methods, including but not limited to welding, bonding, brazing, screwing and mechanical fastening subsequent to dovetailing. Thus the instant invention is not limited the use of one type, or especially one shape, of raw material and is thus not limited by the design and production restrictions inherent with those shapes or materials.

Investigating the features that contribute to the superior operational capabilities of the novel shaft, analysis of the invention in consideration of the laws of physics reveals why this invention provides a faster and more accurate strike.

Considering the force generated and imparted upon an object to be projected, force is a vector quantity, having both magnitude and direction. The basic equation for force is as follows: F=mass×acceleration=m(a) in units of $kg \times m/sec^2$. Thus, if the acceleration could be held constant, the force applied to the ball from the shaft would naturally be greater when a heavier shaft is utilized, since the mass component will be greater than that of a lighter shaft.

In prior designs, due to the constraints inherent with a human user, a loss of acceleration would naturally occur due to the greater shaft mass, since the user can only achieve a maximum moment based on the weight of the shaft. However, the instant design solves this problem through utilization of aerodynamic principles. Due to the airfoil shaped cutout design, as evinced in basic aerodynamic terms, the velocity achieved would be greater as the airfoil exhibits the greatest possible airflow over an object. Prior shafts were designed with cylindrical, hexagonal or some form of polygonal profile. Where the instant invention offers adaptation of similar external profiles, the additional integration of a series of internal airfoil and circular shaped ports channeled through the material creates a far superior flow path. Simply put, the flow directly through a series of smooth airfoils and cylinders is significantly less turbulent than the flow over a solid cylindrical member, as there will be less breakage in the laminar boundary. Thus the overall airflow around and through the instant invention is dramatically enhanced when compared to the flow over a solid cylindrical member. Thus, these flow advantages clearly translate into greater shaft velocity and acceleration.

Thus, even when a metallic material is chosen from which to manufacture the shaft, the greater acceleration and velocity from the aerodynamic advantage will more than compensate for the slight additional weight. Thus, with a heavy shaft, the force delivered to move an object will be maximized. Conversely, when lighter materials are used, the advantage of the instant design can only greatens as the far greater acceleration drastically surpasses the lighter weight in the equation of force generated.

Further investigating momentum considerations, in mechanics, momentum is the quantity of motion of a body, specifically the product of the mass of the body and its velocity, (mass×velocity=kg×m/sec). Momentum is a vector quantity and thus possesses both a magnitude and a direction, the direction being the same as that of the velocity vector. When an external force acts upon a body or a system of bodies in motion, it causes a change in the momentum of the body. The impulse of a force, acting on a body, is the product of the force and the duration of time in which it acts and is equal to the change in momentum of the body. Clearly, following the above analysis, the momentum obtained by the ball should thus be increased by the novel design.

Further and of great import regarding any sports stick are rigidity considerations. Regarding rigidity and the novel truss like design of the instant shaft, engineering principles have long evinced the strength of truss structures, especially where weight considerations are significant. Thus, the instant invention creates a light weight stick, without sacrificing strength. Additionally, as important as strength considerations are to a sports stick, rigidity as opposed to flexure considerations, run hand in hand and often dictate the performance level of a sports stick. Prior art solid shafts exhibit a great amount of flexure due material considerations exhibited by solid materials. However, truss structures evince minimal flexure due the interplay of the materials expansion in to areas where cavities exist.

Further, the sports stick can be a lacrosse stick comprising a shaft wherein the shaft includes at least one internal portion containing an area for mounting a striking surface at least one cutaway area and an external surface and a striking surface, wherein the external surface of the stick comprises two opposing arcuate sides and two opposing flat sides.

Further, the sports stick can be a hockey stick comprising a shaft wherein the shaft includes at least one internal portion containing an area for mounting a striking surface at least one cutaway area and an external surface and a striking surface, wherein the external surface of the stick comprises two opposing arcuate sides and two opposing flat sides.

The lack of flexure innate with a truss design serves to minimize the natural loss of energy occurring on the back or windup stroke during normal usage of the shaft. As such, the user progresses into the throwing stroke without the need to compensate for or overcome a huge loss of energy due to flexure. Thus, the lack of flexure allows the user more time and accuracy since the shaft will not flex during a shot and therefore the ball is more likely to arrive at its intended target.

Moreover, due to the ridged curved truss design, the instant invention is extremely durable and thus, unlike other tubular shaped handles, this design will not buckle and bend when dented under normal playing conditions. The truss system also allows for a slight twisting or rotation of the handle to allow the head to adjust to the playing surface when retrieving a ground ball or striking an object and colliding with any surface.

A sports stick comprising a shaft wherein said shaft includes at least one internal portion containing an area for mounting a striking surface, a striking surface, comprising two opposing arcuate sides and two opposing flat sides, an upper section, a lower section, at least one external surface, at least one cutaway wherein the shaft is designed to have at least one surface adapted to receive at least one weighted element.

The sports stick can further comprise multiple cutaway areas or multiple upper section cutaway areas wherein said multiple upper section cutaway areas include a first upper section cutaway area, a second upper section cutaway area, a third upper section cutaway area, a fourth upper section cutaway area and a fifth upper section cutaway area.

The sports stick can further comprise multiple lower section cutaway areas. including a first lower section cutaway area, a second lower section cutaway area, a third lower section cutaway area, a fourth lower section cutaway area and a fifth lower section cutaway area.

In order to provide a stick wherein weight can be regulated in multiple regions throughout, the sports stick can also comprise at least one weighted element or a multiplicity of weighted elements which may be fixed or removable attached. Further, the weight of the stick may be regulated by altering the sizing of the cutaways or set holes to produce a heavier or lighter shaft as required.

Further the sports stick may include at least one internal surface and at least one external surface, an upper section, a median section and a lower section and wherein at least a portion of said shaft comprises an I-beam structure, as known in the structural and construction arts. Further, the upper section, median section or lower section of said shaft each may comprise an I-beam structure or any combination thereof may contain an I-beam structure.

Additionally, the sports stick may contain at least one or two external surface with comprise two opposing arcuate portions and two opposing flat portions. The two external surfaces may also comprise two semi circular members. The sports stick may also contain at least one internal surface which can be cylindrical or rectangular and a set of edges of the internal surface may meet at a ninety degree angle and at a radius. Further the internal surface may comprises one or two load supporting member.

In an additional embodiment, a sports stick of the type having a relatively long handle shaft characteristic of a hockey or lacrosse stick and a striking end secured to the handle shaft which is adapted to control and propel a ball or puck, the striking end being designed for the intended sport; wherein the handle shaft is formed primarily of a single, hollow primary tube having an interior, the handle shaft being adapted to be held by a player; wherein the handle shaft is fabricated of a relatively rigid material with limited flexibility; wherein the tube has at least one pair of aligned holes extending through opposite wall portions of the tube; and wherein the handle shaft further includes a hollow port tube associated with each the pair of holes, each port tube having opposite ends disposed in the pair of holes and extending across the interior of the primary tube, and wherein the opposite ends are bonded to the opposite wall portions within the holes to form a port extending across the interior.

Additionally, the primary tube and each port tube may be constructed of composite material and the handle shaft and said striking end are one piece or separate pieces. Also, the handle shaft may include a plurality of pairs of aligned holes and a corresponding number of port tubes and the handle shaft may have a longitudinal axis, and the at least one port may be generally oval in shape, to form a pair of arches, with the long dimension of the oval axially oriented. And, the handle shaft may possess a longitudinal axis, wherein the ports are at least generally oval in shape, to form a pair of arches, with the long dimension of the oval axially oriented.

The stick as illustrated herein may be utilized in many sports, including but not limited to a field hockey stick, a lacrosse stick, baseball bat or other such design. The handle shaft may be formed by heat molding a composite material having unidirectional fibers, and the holes and port tube are formed by providing a pre-preg tube about a mold member, and positioning the pre-preg tube and mold member, prior to molding, between fibers on the opposite wall portions, so that, during molding, the holes are formed without breaking or cutting of fibers.

Moreover, in one embodiment, the stick may comprise a composite hockey stick for producing geometric shapes and improving the flexibility and strength and other playing characteristics of the hockey stick comprising, in combination. The stick handle may be fabricated of a handle tube of multiple plies of carbon filaments held together with an epoxy binder, the filaments of each ply being parallel to one another, the stick handle having a long generally hollow rectangular configuration having a top end, a bottom end, a front face, a rear face, and a pair side faces; at least one pair of aligned holes extending through the front and rear faces. Additionally, the stick may comprise a hollow port tube extending through each of the pair side faces, wherein the port tube has a peripheral wall and opposite ends, and wherein the opposite ends are disposed in said holes and bonded to the handle tube.

While there are shown and described herein certain specific structures embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A sports stick comprising:

a shaft wherein said shaft comprises at least one internal portion, at least one through cavity, and an external surface; and, a striking surface, wherein said external surface of said stick comprises two opposing arcuate sides and two opposing flat sides in parallel along the same axis and wherein said stick contains circular airflow cutouts.

2. The sports stick of claim 1 wherein said arcuate sides contain a series grooved gripping areas.

3. The sports stick of claim 2 wherein said series of grooved gripping areas extend the length of the stick.

4. The sports stick of claim 1 wherein said striking surface is selected from the group consisting of a lacrosse head, a blade, a racquet, and a golf club head.

5. The sports stick of claim 1, wherein said shaft contains an area where a handle is mounted.

6. The sports stick of claim 1, wherein said shaft contains circular airflow cutouts in the area where said striking surface is mounted.

7. The sports stick of claim 1, wherein said shaft contains circular airflow cutouts in the area where said striking surface is mounted and said shaft contains circular airflow cutouts in the area where said handle is mounted.

8. The sports stick of claim 1, wherein said shaft includes a plurality of external reinforcing ribs.

9. A sports stick of the type having a relatively long handle shaft characteristic of a hockey or lacrosse stick and a striking end secured to said handle shaft which is adapted to control and propel a ball or puck, the striking end being designed for the intended sport; wherein said handle shaft is formed primarily of a single, hollow primary tube having an interior, said handle shaft being adapted to be held by a player; wherein said handle shaft is fabricated of a relatively rigid material with limited flexibility wherein said handle shaft contains circular airflow cutouts; wherein said tube has at least one pair of aligned holes extending through opposite wall portions of said tube; and wherein said handle shaft further includes a hollow port tube associated with each said pair of holes, each port tube having opposite ends disposed in said pair of holes and extending across the interior of said primary tube, and wherein said opposite ends are bonded to said opposite wall portions within said holes to form a port extending across said interior.

10. The stick as set forth in claim 9, wherein the primary tube and each port tube are made of composite material.

11. The stick as set forth in claim 10, wherein said handle shaft has a longitudinal axis, and wherein said at least one port is at least generally oval in shape, to form a pair of arches, with the long dimension of the oval axially oriented.

12. The stick as set forth in claim 9, wherein said handle shaft and said striking end are one piece.

13. The stick as set forth in claim 9, wherein the handle and striking end are separate pieces.

14. The stick as set forth in claim 9, wherein said handle shaft includes a plurality of pairs of aligned holes and a corresponding number of port tubes.

15. The stick as set forth in claim 9, wherein said handle shaft has a longitudinal axis, and wherein said ports are at least generally oval in shape, to form a pair of arches, with the long dimension of the oval axially oriented.

16. The stick set forth in claim 9, wherein said stick may be selected from the group consisting of a field hockey stick and a lacrosse stick.

17. The stick set forth in claim 9, wherein said handle shaft is formed by heat molding a composite material having uni-directional fibers, and wherein said holes and port tube are formed by providing a pre-preg tube about a mold member, and positioning the pre-preg tube and mold member, prior to molding, between fibers on said opposite wall portions, so that, during molding, said holes are formed without breaking or cutting of fibers.

* * * * *